US010254695B2

(12) United States Patent
Yabuki

(10) Patent No.: US 10,254,695 B2
(45) Date of Patent: Apr. 9, 2019

(54) IMAGE FORMING APPARATUS, AND METHOD AND COMPUTER-READABLE MEDIUM THEREFOR

(71) Applicant: Brother Kogyo Kabushiki Kaisha, Nagoya-shi, Aichi-ken (JP)

(72) Inventor: Tomoyasu Yabuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/939,513

(22) Filed: Mar. 29, 2018

(65) Prior Publication Data

US 2018/0284681 A1 Oct. 4, 2018

(30) Foreign Application Priority Data

Mar. 31, 2017 (JP) ..... 2017-069520

(51) Int. Cl.
*G03G 15/00* (2006.01)
*G03G 15/08* (2006.01)

(52) U.S. Cl.
CPC ..... *G03G 15/556* (2013.01); *G03G 15/0812* (2013.01); *G03G 15/0822* (2013.01); *G03G 15/0862* (2013.01); *G03G 15/0894* (2013.01); *G03G 2215/0894* (2013.01)

(58) Field of Classification Search
CPC ..... G03G 15/556; G03G 15/0822; G03G 15/0856–15/0865; G03G 2215/0888–2215/0894
See application file for complete search history.

(56) References Cited

U.S. PATENT DOCUMENTS

| | | | | |
|---|---|---|---|---|
| 7,920,799 | B2 | 4/2011 | Wada et al. | |
| 8,774,648 | B2 | 7/2014 | Ogino | |
| 2006/0263106 | A1* | 11/2006 | Yamaguchi | G03G 15/0856 399/27 |
| 2008/0285986 | A1 | 11/2008 | Wada et al. | |
| 2009/0060533 | A1 | 3/2009 | Yamaguchi | |
| 2012/0230730 | A1 | 9/2012 | Ogino | |

FOREIGN PATENT DOCUMENTS

| | | | |
|---|---|---|---|
| JP | 2008-164909 | A | 7/2008 |
| JP | 2008-286870 | A | 11/2008 |
| JP | 2009-075574 | A | 4/2009 |
| JP | 2010-002771 | A | 1/2010 |
| JP | 2012-189712 | A | 10/2012 |

* cited by examiner

*Primary Examiner* — Carla J Therrien
(74) *Attorney, Agent, or Firm* — Banner & Witcoff, Ltd.

(57) ABSTRACT

An image forming apparatus includes a controller configured to, each time a development roller of a developing device rotates by a particular rotational amount, increment a counter value stored in a storage, calculate a remaining amount of developer in the developing device, when the counter value is less than a first value, setting a remaining amount threshold to a first threshold, whereas, when the counter value is equal to or more than a second value, setting the remaining amount threshold to a second threshold, the second value being equal to or more than the first value, the second threshold being less than the first threshold, and when the calculated remaining amount is less than the set remaining amount threshold, control a transporter to transport developer stored in a developer box to the developing device.

14 Claims, 10 Drawing Sheets

IMAGE FORMING APPARATUS, AND METHOD AND COMPUTER-READABLE MEDIUM THEREFOR

CROSS-REFERENCE TO RELATED APPLICATION

This application claims priority under 35 U.S.C. § 119 from Japanese Patent Application No. 2017-069520 filed on Mar. 31, 2017. The entire subject matter of the application is incorporated herein by reference.

BACKGROUND

Technical Field

Aspects of the present disclosure are related to an image forming apparatus to which a toner box and a developing device are attached in a separately detachable manner, and a method and a computer-readable medium therefor.

Related Art

Heretofore, an electrophotographic image forming apparatus, to which a toner box and a developing device are attached in a separately detachable manner, has been known. The toner box and the developing device are individually replaced with new ones after a lapse of respective service lives.

For example, for the known apparatus, a technique has been disclosed in which the apparatus detects a consumed amount of developer (e.g., toner), calculates an integrated developer consumption by integrating the consumed amount of developer, and supplies a predetermined amount of developer each time the integrated developer consumption exceeds a developer supply threshold. Further, according to the disclosed technique, the known apparatus detects an amount of developer stored in the developing device and corrects the developer supply threshold based on the detected amount of developer.

SUMMARY

However, the known apparatus has the following problem. That is, the known apparatus supplies the predetermined amount of developer whenever the integrated developer consumption exceeds the developer supply threshold, without taking account of the service life of the developing device. Consequently, the developing device might reach the end of its service life before using up the supplied developer. In such a case, it is wasteful consumption of resources to dispose of developer remaining in the developing device without using it for image formation.

Aspects of the present disclosure are advantageous to provide one or more techniques, for an image forming apparatus to which a toner box and a developing device are attached in a separately detachable manner, which make it possible to reduce wasteful disposal of developer.

According to aspects of the present disclosure, an image forming apparatus is provided, which includes an image carrying body configured to carry an electrostatic latent image thereon, a developing device including a development roller configured to carry developer thereon, and a developing chamber configured to store developer therein, a developer box including a developer container configured to store developer therein, and a transporter configured to transport the developer stored in the developer container to the developing chamber of the developing device, a developer sensor configured to output a signal varying depending on an amount of the developer stored in the developing chamber, a storage configured to store a counter value, and a controller. The controller is configured to perform a developing process to control the developing device to supply the developer stored in the developing chamber to the electrostatic latent image carried on the image carrying body, thereby developing the electrostatic latent image, a counting process to, each time the development roller rotates by a particular rotational amount, increment the counter value stored in the storage, a developer remaining amount calculating process to calculate a remaining amount of developer in the developing chamber, based on the signal received from the developer sensor, a threshold setting process including setting a remaining amount threshold to a first threshold when the counter value is less than a first value, and setting the remaining amount threshold to a second threshold when the counter value is equal to or more than a second value, the second value being equal to or more than the first value, the second threshold being less than the first threshold, and a developer supply process to, when the calculated remaining amount is less than the set remaining amount threshold, control the transporter to transport the developer stored in the developer container to the developing chamber.

According to aspects of the present disclosure, further provided is a method implementable on a processor coupled with an image forming apparatus. The image forming apparatus includes an image carrying body configured to carry an electrostatic latent image thereon, a developing device including a development roller configured to carry developer thereon, and a developing chamber configured to store developer therein, a developer box including a developer container configured to store developer therein, and a transporter configured to transport the developer stored in the developer container to the developing chamber of the developing device, a developer sensor configured to output a signal varying depending on an amount of the developer stored in the developing chamber, and a storage configured to store a counter value. The method includes controlling the developing device to supply the developer stored in the developing chamber to the electrostatic latent image carried on the image carrying body, thereby developing the electrostatic latent image, incrementing the counter value stored in the storage each time the development roller rotates by a particular rotational amount, calculating a remaining amount of developer in the developing chamber, based on the signal received from the developer sensor, setting a remaining amount threshold to a first threshold when the counter value is less than a first value, whereas setting the remaining amount threshold to a second threshold when the counter value is equal to or more than a second value, the second value being equal to or more than the first value, the second threshold being less than the first threshold, and when the calculated remaining amount is less than the set remaining amount threshold, controlling the transporter to transport the developer stored in the developer container to the developing chamber.

According to aspects of the present disclosure, further provided is a non-transitory computer-readable medium storing computer-readable instructions that are executable by a processor coupled with an image forming apparatus. The image forming apparatus includes an image carrying body configured to carry an electrostatic latent image thereon, a developing device including a development roller configured to carry developer thereon, and a developing chamber configured to store developer therein, a developer box including a developer container configured to store developer therein, and a transporter configured to transport the developer stored in the developer container to the developing chamber of the developing device, a developer sensor configured to output a signal varying depending on an amount of the developer stored in the developing chamber, and a storage configured to store a counter value. The instructions are configured to, when executed by the processor, cause the processor to perform a developing process to control the developing device to supply the developer stored in the developing chamber to the electrostatic latent image carried on the image carrying body, thereby developing the electrostatic latent image, a counting process to, each time the development roller rotates by a particular rotational amount, increment the counter value stored in the storage, a developer remaining amount calculating process to calculate a remaining amount of developer in the developing chamber, based on the signal received from the developer sensor, a threshold setting process including setting a remaining amount threshold to a first threshold when the counter value is less than a first value, and setting the remaining amount threshold to a second threshold when the counter value is equal to or more than a second value, the second value being equal to or more than the first value, the second threshold being less than the first threshold, and a developer supply process to, when the calculated remaining amount is less than the set remaining amount threshold, control the transporter to transport the developer stored in the developer container to the developing chamber.

BRIEF DESCRIPTION OF THE ACCOMPANYING DRAWINGS

Figure 3:
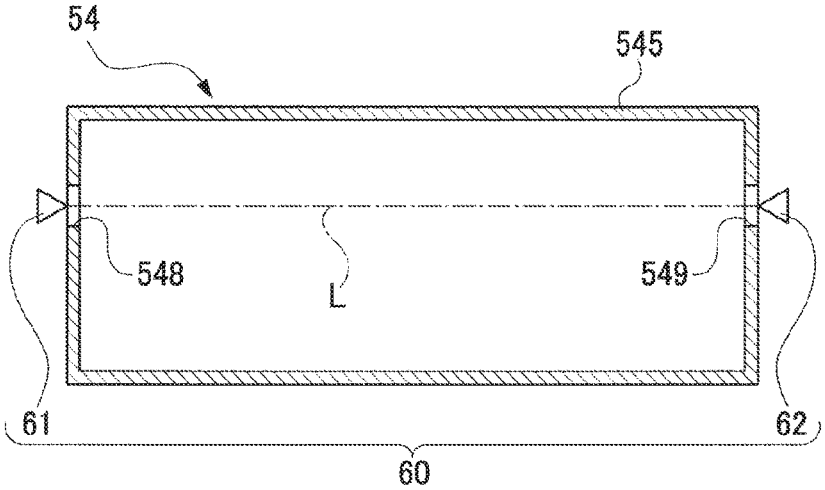

FIG. 3 schematically shows a positional relationship between a toner sensor and the developing device in the printer in the first illustrative embodiment according to one or more aspects of the present disclosure.

Figure 4:
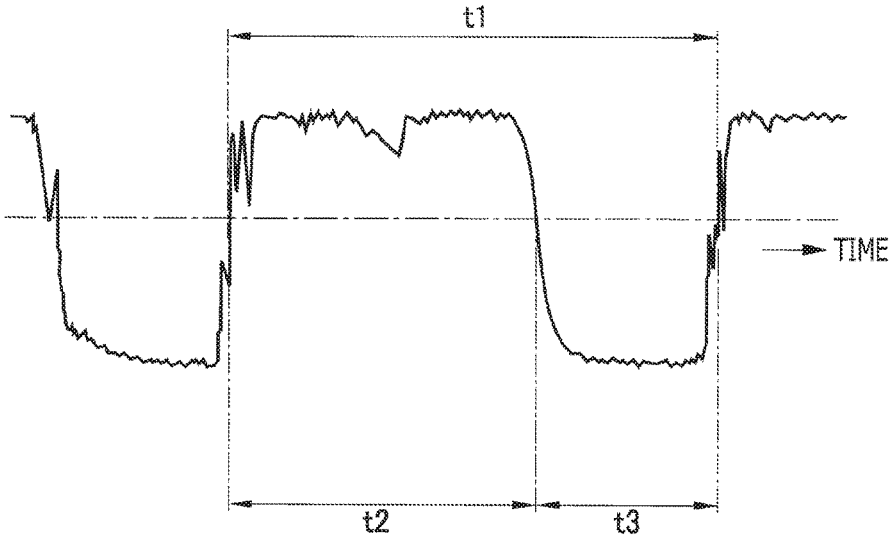

FIG. 4 is a graph exemplifying a time variation of an amount of light received across the developing device by the toner sensor, in the first illustrative embodiment according to one or more aspects of the present disclosure.

Figure 5:
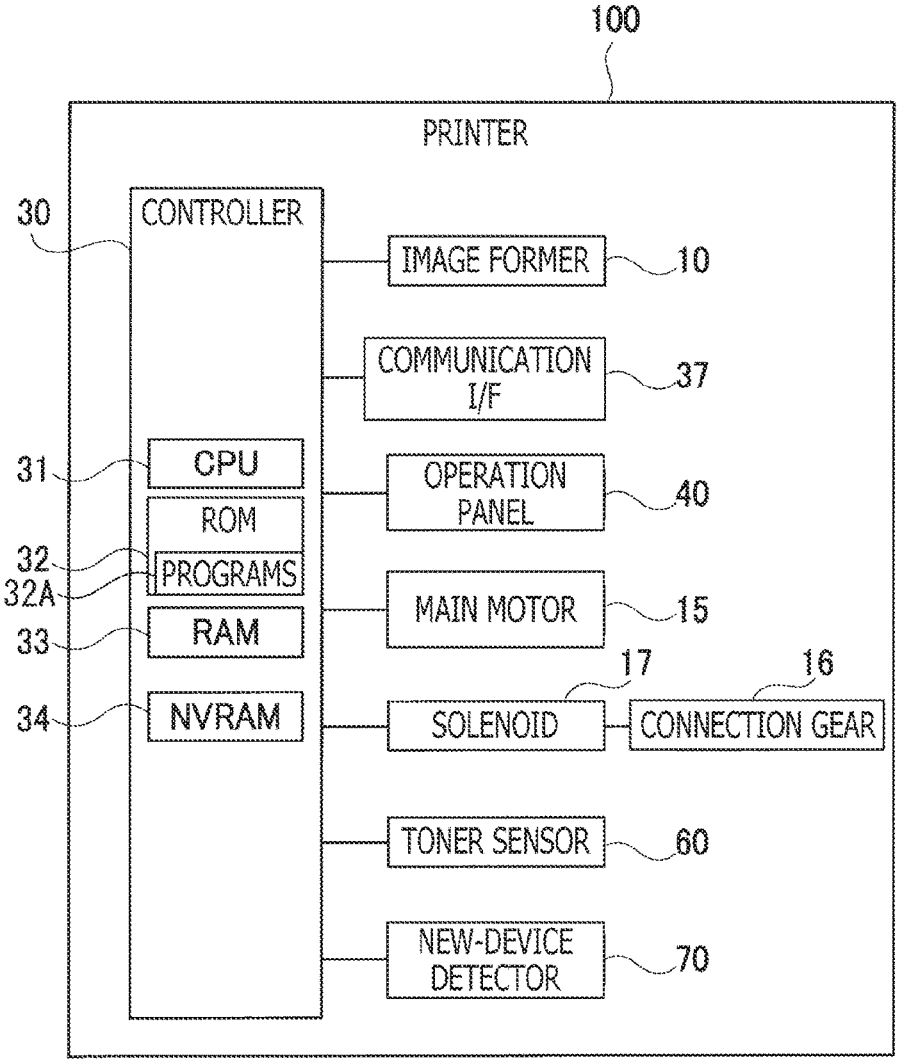

FIG. 5 is a block diagram schematically showing an electrical configuration of the printer in the first illustrative embodiment according to one or more aspects of the present disclosure.

Figure 6:
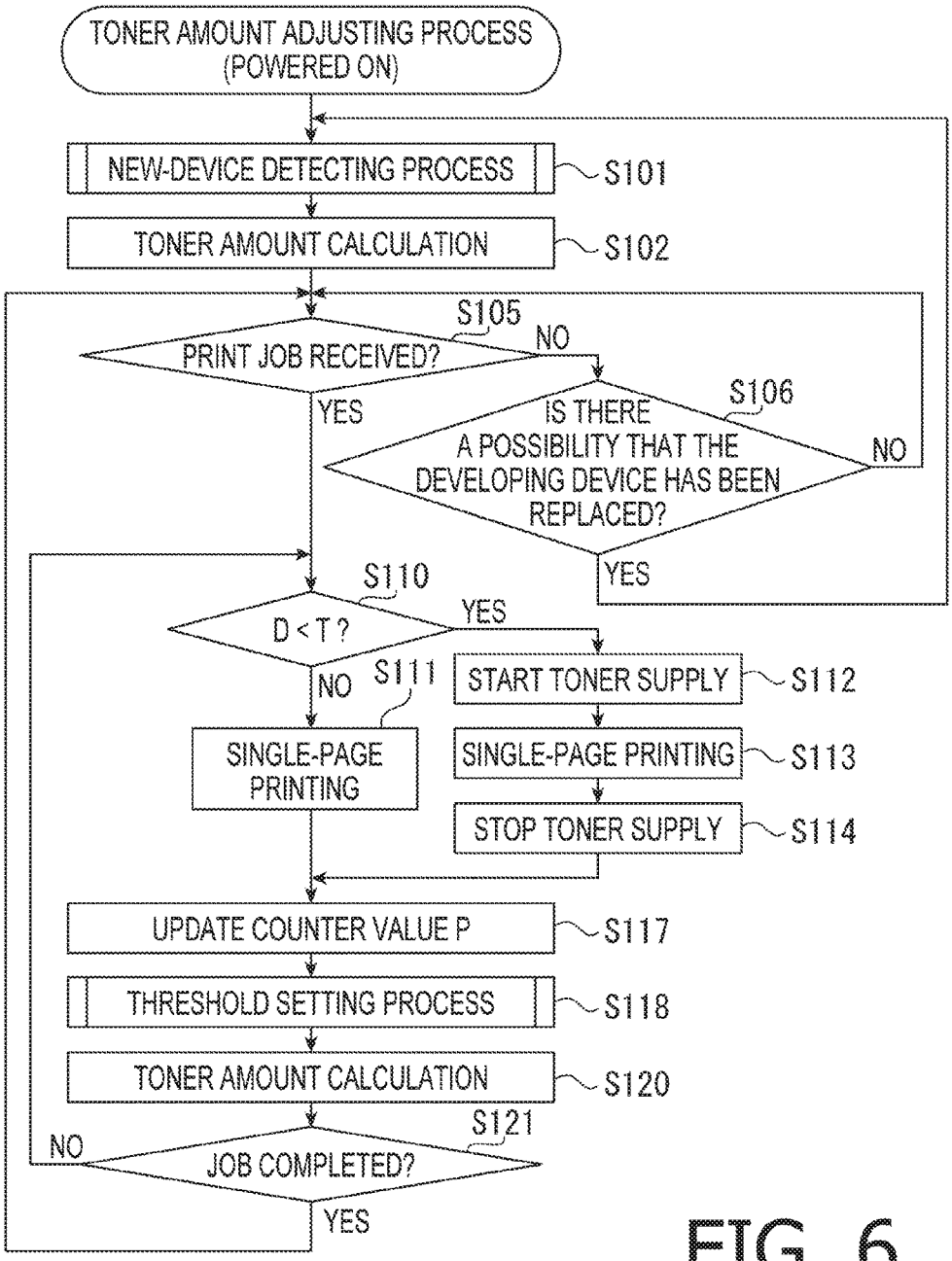

FIG. 6 is a flowchart showing a procedure of a toner amount adjusting process in the first illustrative embodiment according to one or more aspects of the present disclosure.

Figure 7:
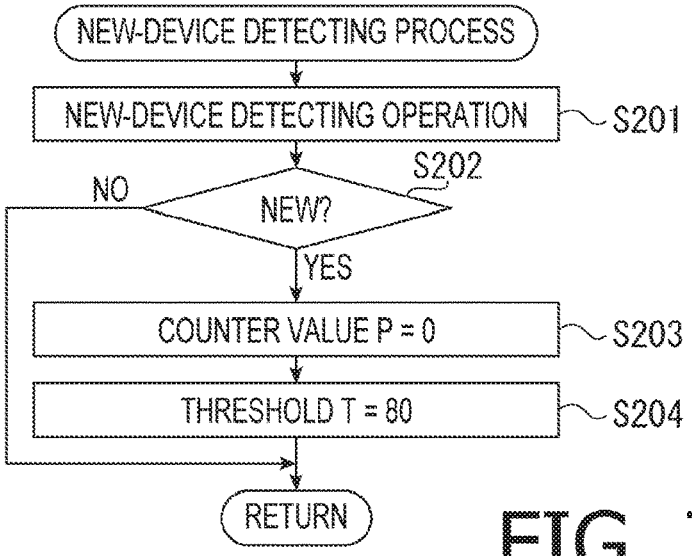

FIG. 7 is a flowchart showing a procedure of a new-device detecting process in the first illustrative embodiment according to one or more aspects of the present disclosure.

Figure 8:
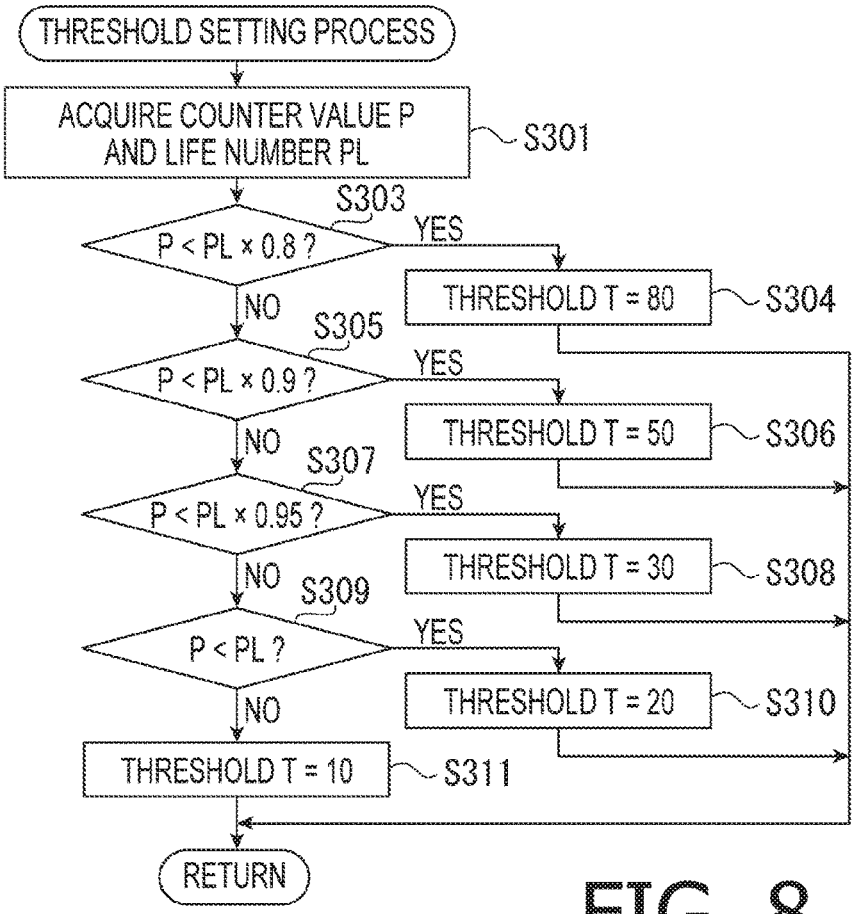

FIG. 8 is a flowchart showing a procedure of a threshold setting process in the first illustrative embodiment according to one or more aspects of the present disclosure.

Figure 9:
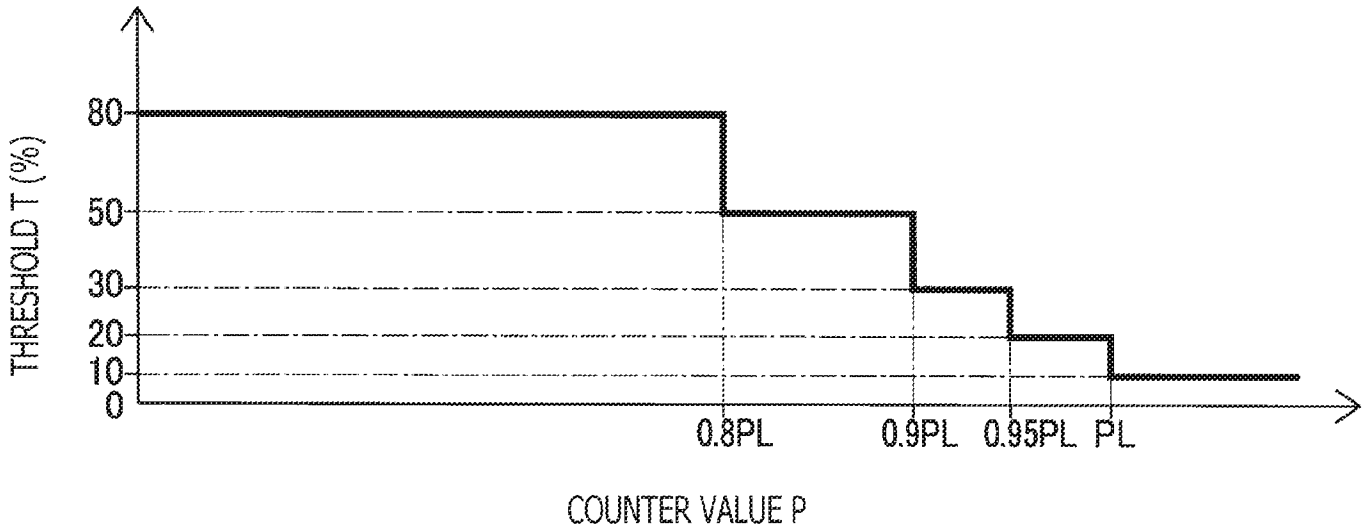

FIG. 9 is a graph showing a relationship between a counter value that indicates an accumulated number of rotations of a development roller of the developing device and a threshold that corresponds to a maximum allowable amount of toner stored in the developing device, in the first illustrative embodiment according to one or more aspects of the present disclosure.

Figure 10:
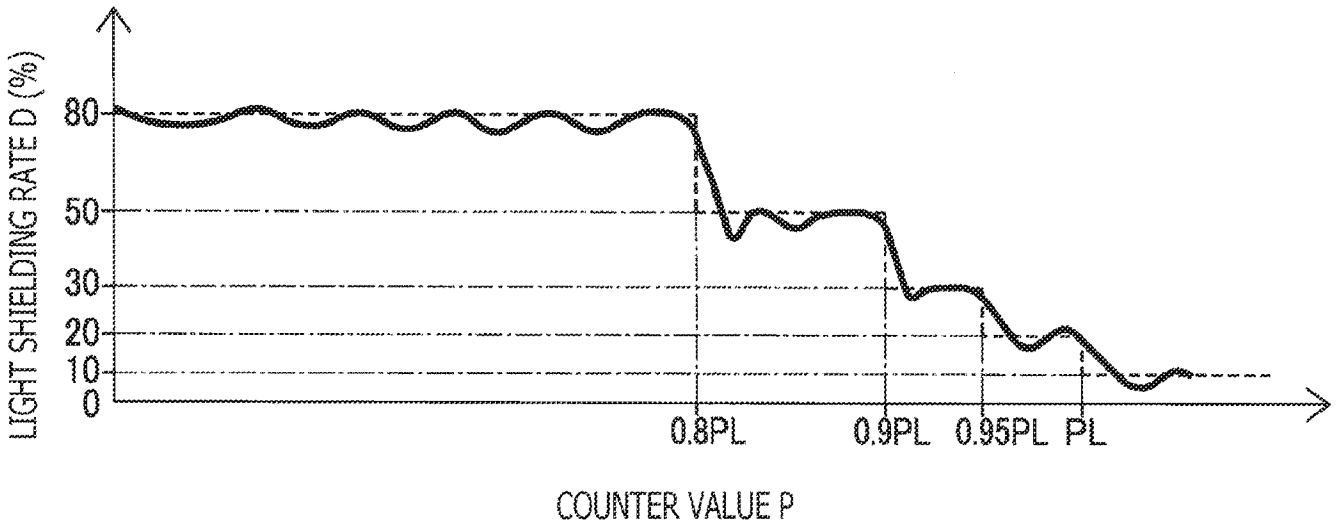

FIG. 10 is a graph exemplifying a relationship between the counter value and a light shielding rate, in the first illustrative embodiment according to one or more aspects of the present disclosure.

Figure 11:
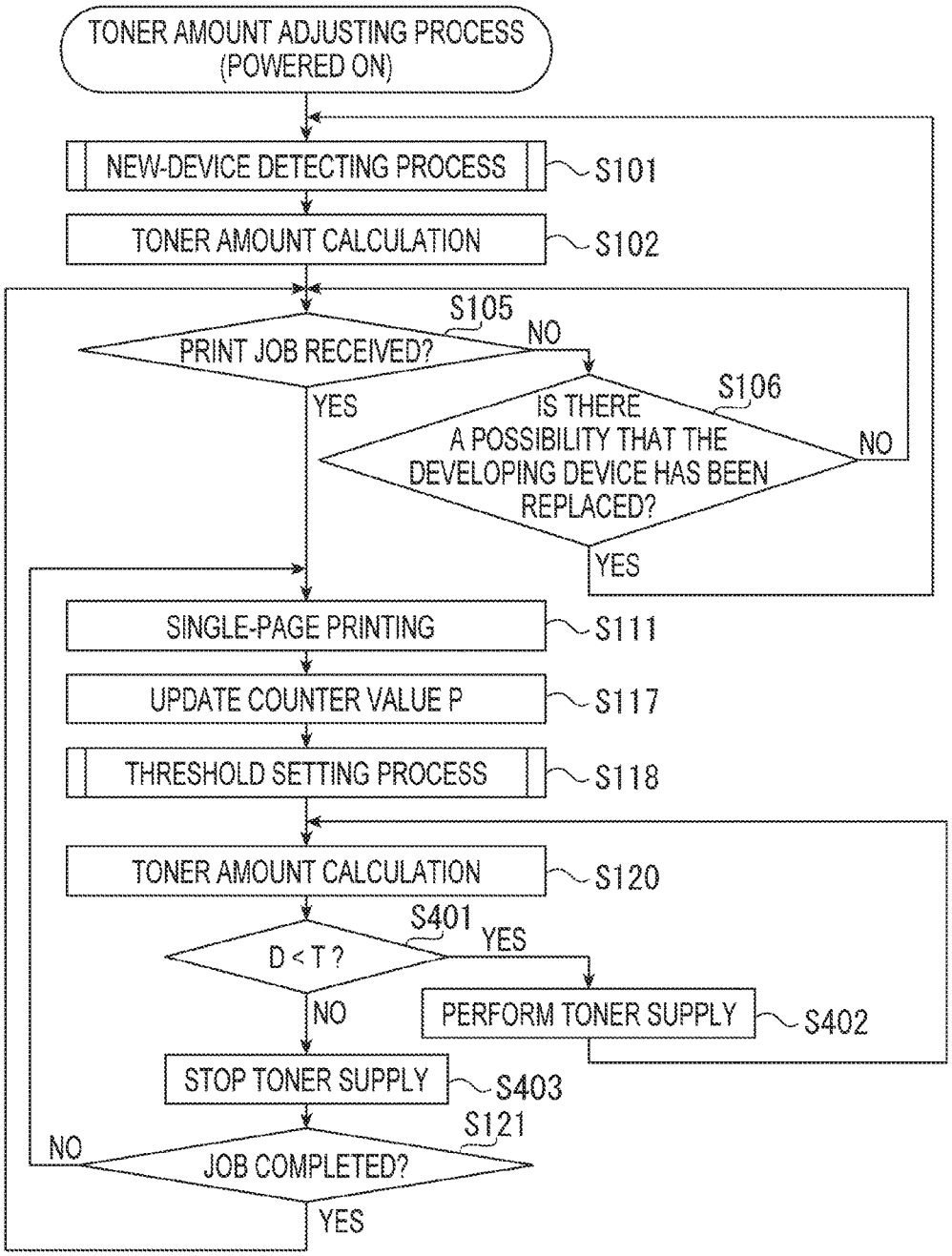

FIG. 11 is a flowchart showing a procedure of a toner amount adjusting process in a second illustrative embodiment according to one or more aspects of the present disclosure.

Figure 12:
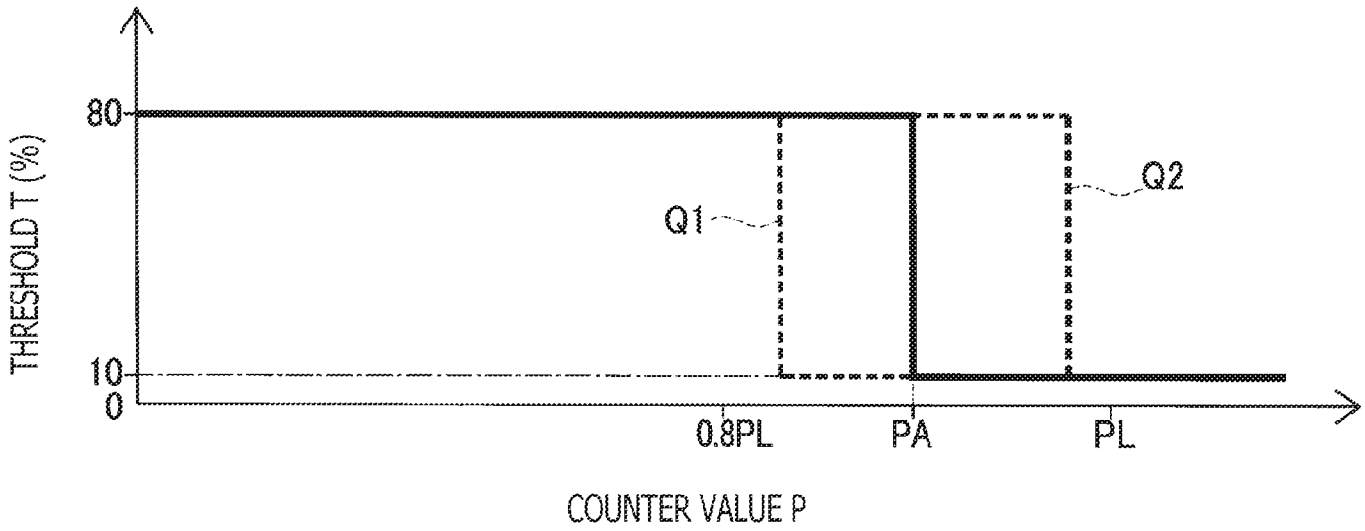

FIG. 12 is a graph showing a relationship between the counter value and the threshold, in a modification according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

First Illustrative Embodiment

Hereinafter, an image forming apparatus in a first illustrative embodiment according to aspects of the present disclosure will be described with reference to the accompanying drawings. In the first illustrative embodiment, aspects of the present disclosure are applied to an electrophotographic printer.

Figure 1:
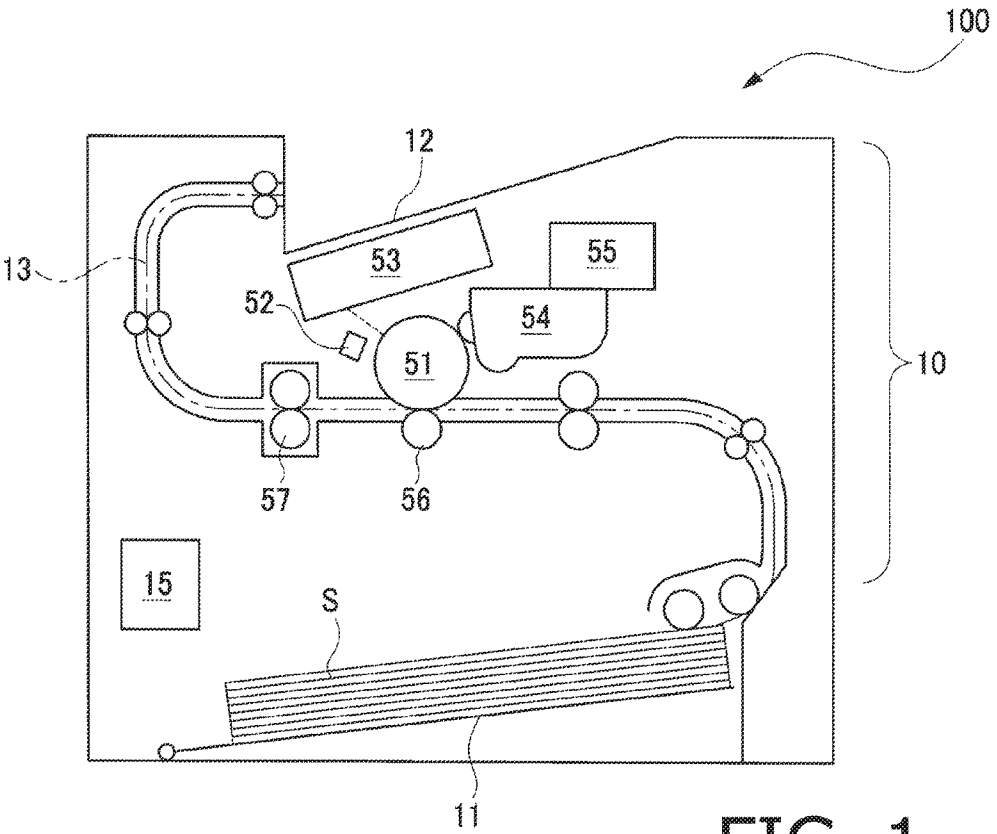
FIG. 1 is a cross-sectional view schematically showing a configuration of a printer in a first illustrative embodiment according to one or more aspects of the present disclosure.

As shown in FIG. 1, a printer 100 of the first illustrative embodiment includes an image former 10, a feed tray 11, and a discharge tray 12. The image former 10 is configured to print an image on a sheet S. The feed tray 11 is configured to support one or more unprinted sheets S placed thereon. The discharge tray 12 is configured to support one or more printed sheets S discharged thereon. Further, inside the printer 100, a sheet conveyance path 13 is formed to extend from the feed tray 11 to the discharge tray 12 via the image former 10. Further, the printer 100 includes a main motor 15 configured to rotate various rotatable members.

The image former 10 of the printer 100 is configured to electrophotographically form an image on a sheet S being conveyed along the sheet conveyance path 13. As shown in FIG. 1, the image former 10 includes a photoconductive body 51, a charger 52, an exposure device 53, a developing device 54, a toner box 55, a transfer member 56, and a fuser 57.

The photoconductive body 51 is a cylindrical photoconductive drum that is rotatable around a rotational axis perpendicular to a flat surface on which FIG. 1 is drawn. The charger 52, the exposure device 53, the developing device 54, and the transfer member 56 are arranged along a circumferential direction of the photoconductive body 51, in the above-referred order in a rotational direction of the photoconductive body 51. The fuser 57 is disposed along the sheet conveyance path 13, in a position downstream of the photoconductive body 51 in a sheet conveyance direction.

The toner box 55 is disposed above the developing device 54. The toner box 55 is connected with the developing device 54.

In an image forming operation, the printer 100 drives the main motor 15, thereby rotating the various rotatable members. The printer 100 applies a charging bias to the charger 51 to charge the photoconductive body 51. Subsequently, the printer 100 causes the exposure device 53 to emit laser light onto the photoconductive body 51 to expose a surface of the photoconductive body 51. Thereby, an electrostatic latent image based on image data is formed on the surface of the photoconductive body 51. Further, the printer 100 applies a developing bias to the developing device 54, thereby causing the developing device 54 to supply toner to the electrostatic latent image formed on the photoconductive body 51. Thus, a toner image is formed on the photoconductive body 51.

The printer 100 feeds a sheet S from the feed tray 11 and conveys the sheet S to a position between the photoconductive body 51 and the transfer member 56 via the sheet conveyance path 13. Then, the printer 100 applies a transfer bias to the transfer member 56, thereby transferring the toner image formed on the photoconductive body 51 onto the sheet S. Further, the printer 100 thermally fixes the toner image transferred on the sheet S by the fuser 57, and discharges the sheet S with the toner image fixed thereon onto the sheet S.

In the printer 100 of the first illustrative embodiment, the developing device 54 and the toner box 55 are separately attachable to and detachable from a main body of the apparatus 100. The developing device 54 and the toner box 55 are individually replaced with new ones in accordance with respective service lives. In other words, replacement timings of the developing device 54 and the toner box 55 may not necessarily come at the same time.

Figure 2:
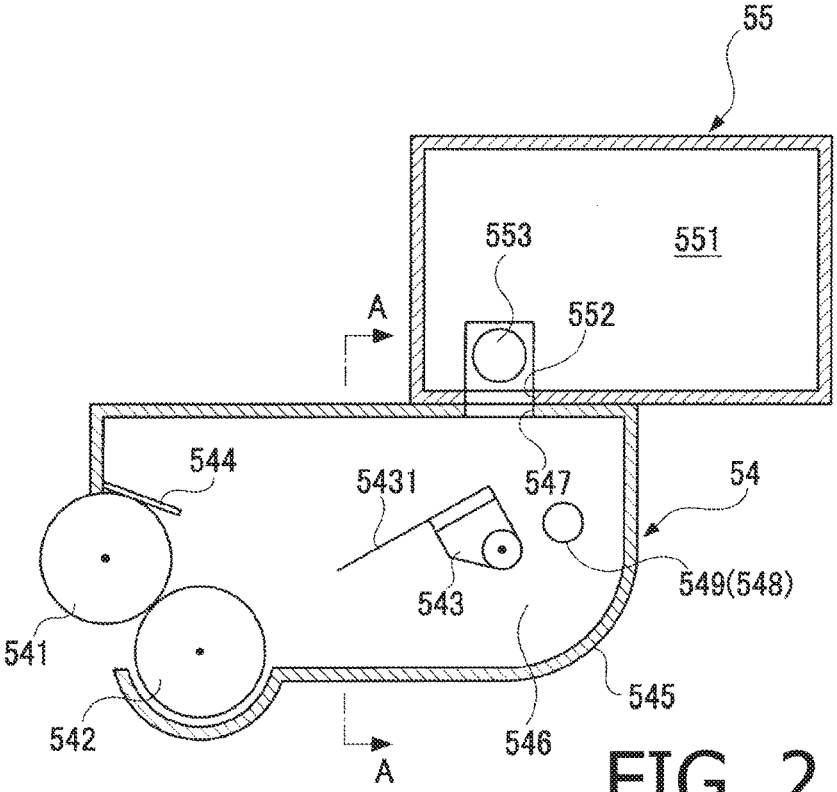
FIG. 2 is a cross-sectional view schematically showing configurations of a developing device and a toner box of the printer in the first illustrative embodiment according to one or more aspects of the present disclosure.

As shown in FIG. 2, the developing device 54 includes a development roller 541, a supply roller 542, and an agitator 543, which are integrated by a housing 545. A toner receiving hole 547 is formed as a through hole in an upper surface of the housing 545. The developing device 54 is configured to store toner received via the toner receiving hole 547, in a developing chamber 546 as an internal space of the housing 545.

Each of the development roller 541, the supply roller 542, and the agitator 543 is configured to rotate in response to receipt of a rotational driving force from the min motor 15. The development roller 541, the supply roller 542, and the agitator 543 are disposed in such a manner that rotational axes thereof are parallel to each other. The supply roller 542 is configured to supply the development roller 541 with the toner stored in the developing chamber 546. The development roller 541 is disposed in such a manner that a part thereof exposed via an opening of the housing 545 is opposed to the photoconductive body 51. The development roller 541 is configured to carry toner supplied by the supply roller 542 and supply the toner to the electrostatic latent image formed on the photoconductive body 51, thereby forming the toner image on the photoconductive body 51. The agitator 543 includes an agitating blade 5431 parallel to the rotational axis of the agitator 543. The agitator 543 is configured to agitate the toner stored in the developing chamber 546 and supply the toner to the supply roller 542. A layer thickness regulating blade 544 is disposed in contact with the development roller 541. The layer thickness regulating blade 544 is configured to adjust a thickness of a toner layer on the development roller 541.

Further, as shown in FIG. 3, the developing device 54 includes light transmissive windows 548 and 549 provided to the housing 545. More specifically, the light transmissive windows 548 and 549 are disposed, respectively, at two end surfaces of the housing 545 in a rotational axis direction of the development roller 541, the supply roller 542, and the agitator 543. FIG. 3 is a cross-sectional view taken along a line A-A shown in FIG. 2. The printer 100 further includes a toner sensor 60 having a light emitting element 61 and a light receiving element 62. When the developing device 54 is attached to the printer 100, the light emitting element 61 is disposed outside one of the light transmissive windows 548 and 549 in the rotational axis direction. When the developing device 54 is attached to the printer 100, the light receiving element 62 is disposed outside the other of the light transmissive windows 548 and 549 in the rotational axis direction. Nonetheless, the light emitting element 61 and the light receiving element 62 may be disposed contrary to the above example in the rotational axis direction.

When a sufficient amount of toner to interrupt transmission of light is present between the two light transmissive windows 548 and 549, the light receiving element 62 receives a small quantity of light, and the toner sensor 60 outputs a high-level signal. Meanwhile, as there is a smaller amount of toner between the two light transmissive windows 548 and 549, the light receiving element 62 receives a larger quantity of light, and the toner sensor 60 outputs a lower-level signal.

A line L connecting the light transmissive window 548 and the light transmissive window 549 is within a movable range of the agitator 543. The printer 100 calculates a numerical value corresponding to an amount of toner remaining in the developing device 54 by receiving the output signal from the toner sensor 60 while rotating the agitator 543. The amount of toner between the light transmissive windows 548 and 549 periodically varies depending on a rotational position of the agitator 543. Therefore, the output signal from the toner sensor 60 periodically varies as well. FIG. 4 shows an example of a waveform of the output signal from the toner sensor 60.

When the agitator 543 rotates, toner is pushed away by the agitating blade 5431. Therefore, immediately after the agitating blade 5431 passes across the line L, the quantity of light received by the light receiving element 62 becomes larger owing to a light transmissive state where an amount of toner on the line L becomes smaller. Afterward, when toner moves along with the rotation of the agitator 543, the quantity of light received by the light receiving element 62 becomes smaller owing to a light shielding state where the amount of toner on the line L becomes larger. When there is a large amount of toner stored in the developing chamber 546, toner is fully supplied on the line L shortly after the agitating blade 5431 passes across the line L. Hence, the light transmissive state is maintained for a short period of time. Meanwhile, when there is a small amount of toner stored in the developing chamber 546, it takes a long time for toner to be fully supplied on the line L after the agitating blade 5431 passes across the line L. Hence, the light transmissive state is maintained for a long period of time.

Therefore, as shown in FIG. 4, the printer 100 digitizes the output signal from the toner sensor 60, and estimates the amount of toner stored in the developing chamber 546 based on a ratio of a second time period t2 of the light shielding state or a third time period t3 of the light transmissive state to a first time period t1 required for a single rotation of the agitator 546. For instance, the printer 100 may calculate a light shielding rate D (%) represented by the following expression 1.

$$D(\%)=(t2/t1)\times 100 \quad \text{(Expression 1)}$$

As the amount of toner stored in the developing chamber 546 increases, the third time period t3 of the light transmissive state becomes shorter, and a ratio of the second time period t2 of the light shielding state to the first time period t1 becomes larger. Namely, as the amount of toner remaining in the developing chamber 546 increases, the light shielding rate D becomes larger. The light shielding rate D is a value corresponding to the amount of toner remaining in the developing chamber 546. Hereinafter, a sequence of operations for calculating the light shielding rate D may be referred to as a "toner amount calculation."

As shown in FIG. 2, the toner box 55 includes a toner container 551, a toner delivery hole 552, and a toner delivery pump 553. When the developing device 54 and the toner box 55 are attached to the printer 100, the toner receiving hole 547 of the developing device 54 is connected with the toner delivery hole 552 of the toner box 55. Thereby, the developing chamber 546 of the developing device 54 is brought into communication with the toner container 551 of the toner box 55.

For instance, the toner delivery pump 553 may have a spiral delivery blade, and may be rotated by the rotational driving force from the main motor 15. The toner stored in the toner container 551 is transported toward the toner delivery hole 552 in response to rotation of the toner delivery pump 553, thereby coming into the developing chamber 546 of the developing device 54 via the toner delivery hole 552 and the toner receiving hole 547. Namely, the printer 100 transports the toner stored in the toner container 551 of the toner box 55 into the developing chamber 546 of the developing device 54, by rotating the toner delivery pump 553.

The printer 100 further includes a connection gear 16 (see FIG. 5) and a solenoid 17 (see FIG. 5), to switch whether or not to transmit the rotational driving force from the main motor 15 to the toner delivery pump 553. The solenoid 17 is configured to switch a connection state of the connection gear 16 between a connected state where the driving force from the main motor 15 is transmitted to the toner delivery pump 553 and an unconnected state where the driving force from the main motor 15 is not transmitted to the toner delivery pump 553. By bringing the connection gear 16 into the connected state while driving the main motor 15, the printer 100 rotates the toner delivery pump 553. Further, by bringing the connection gear 16 into the unconnected state, the printer 100 stops the toner delivery pump 553, thereby stopping transportation of the toner.

The printer 100 further includes a new-device detector 70 (see FIG. 5) configured to detect whether the developing device 54 has been replaced with a new one. More specifically, the new-device detector 70 is configured to output different signals depending on whether the developing device 54 is new or used. The image forming apparatus 10 determines whether the developing device 54 is new, in response to receiving the signal from the new-device detector 70 when being powered on or after detecting whether a cover is open or closed.

For instance, the new-device detector 70 may be configured to detect rotation of a toothless gear attached to a rotational shaft of the development roller 541 of the developing device 54. When a new developing device 54 is attached to the main body of the printer 100, the toothless gear is placed in a position where the toothless gear engages with a drive gear of the main body and receives the rotational driving force from the main motor 15. Then, when the toothless gear is rotated by a particular angle in response to receiving the rotational driving force from the main motor 15 after the new developing device 54 has been attached to the main body of the printer 100, the toothless gear is placed in a position where the toothless gear does not engage with the drive gear of the main body, owing to a toothless portion of the toothless gear. Namely, once the developing device 54 begins to be used, even if the developing device is detached from the printer 100 and again attached thereto, the toothless gear does not rotate. For instance, the printer 100 may determine whether the developing device 54 is new, by rotating the main motor 15 and receiving the signal from the new-device detector 70 when the printer 100 is powered on.

As configurations for detecting whether the developing device 54 is new, the following configurations may be employed as well as the aforementioned exemplary configuration having the toothless gear. For instance, the developing device 54 may have a memory configured to store information on whether the developing device 54 is new. Further, for instance, the developing device 54 may have a protrusion configured to physically deform in response to the developing device 54 being attached to the printer 100. Additionally, for instance, the developing device 54 or the printer 100 may be configured to accept a user input representing that the developing device 54 has been replaced with a new one.

Subsequently, an electrical configuration of the printer 100 will be described. As shown in FIG. 5, the printer 100 includes a controller 30. The controller 30 includes a CPU 31, a ROM 32, a RAM 33, and an NVRAM ("NVRAM" is an abbreviated form of "Non-Volatile Random Access Memory") 34. Further, the printer 100 includes the image former 10, a communication interface (hereinafter referred to as a "communication I/F") 37, an operation panel 40, the main motor 15, the solenoid 17 for driving the connection gear 16, the toner sensor, and the new-device detector 70, which are electrically connected with the controller 30.

The ROM 32 is configured to store programs 32A for controlling the printer 100, settings, and initial values. The RAM 33 and the NVRAM 34 may be used as work areas in which the programs 32A are loaded, or may be used as storage areas to temporarily store data.

The CPU 31 is configured to, in accordance with the programs 32A loaded from the ROM 32, perform control processes (e.g., a below-mentioned toner amount adjusting process) to control each of elements included in the printer 100 while storing processing results into the RAM 33 or the NVRAM 34. It is noted that the "controller 30" shown in FIG. 5 may be a generic term for collectively referring to hardware elements (e.g., the CPU 31) necessary for controlling the printer 100. Namely, the "controller 30" may represent but may not necessarily represent a single actual hardware element of the printer 100.

The communication I/F 37 is a hardware element for communicating with an external device via a network in a wired or wireless communication method. The operation panel 40 is configured to display thereon various messages for users and to accept user's inputs.

Subsequently, a toner amount adjusting operation by the printer 100 will be described. As described before, the printer 100 includes the developing device 54 and the toner box 55 that are separately and detachably attached to the printer 100. When the developing device 54 is replaced with a new one, toner stored in the developing device 54 is disposed of. Therefore, at the time of replacement of the developing device 54, it is preferable that a small amount of toner is stored in the developing chamber 546 of the developing device 54.

The developing device 54 has such a tendency that when the accumulated number of rotations of the development roller 541 exceeds a particular value, it causes a larger degree of wear of the development roller 541 and a larger degree of deterioration of a seal for preventing a toner leak. This may be referred to as a "service life" of the developing device 54. In the first illustrative embodiment, the printer 100 stores, in the NVRAM 34, a counter value P indicating an accumulated number of rotations of the development roller 541. When the counter value P reaches a predetermined life number PL, the printer 100 displays on the operation panel 40 a message that prompts the users to replace the developing device 54.

Further, the printer 100 sets a threshold T corresponding to a maximum allowable value of the amount of toner stored in the developing chamber 546, and stores the threshold T in the NVRAM 34. The printer 100 controls transportation of toner based on the light shielding rate D calculated in the aforementioned toner amount calculation and the threshold T. Specifically, when the light shielding rate D is less than the threshold T, the printer 100 drives the toner delivery pump 553 to transport toner from the toner box 55 to the developing device 54. Meanwhile, when the light shielding rate D is equal to or more than the threshold T, the printer 100 does not transport toner.

Then, the printer 100 changes the threshold T based on the counter value P. When the developing device 54 is sufficiently new, the printer 100 sets the threshold T to a maximum value within a range to allow the agitator 543 to appropriately agitate toner. For instance, when the counter value P is less than 80% of the life number PL, the printer 100 sets the threshold T to 80. In a state where the threshold T is set to 80, when the calculated light shielding rate D is less than 80%, the printer 100 transports toner from the toner box 55 to the developing device 54. Meanwhile, in the state, when the calculated light shielding rate D is equal to or more than 80%, the printer 100 does not transport toner.

Meanwhile, when the counter value P reaches the life number PL, the printer 100 sets the threshold T to a minimum value within a range to allow the development roller 541 to appropriately rotate. For instance, when the counter value P is equal to or more than the life number PL, the Printer 100 sets the threshold T to 10. In a state where the threshold T is set to 10, when the light shielding rate D is less than 10%, the printer 100 transports toner from the toner box 55 to the developing device 54. Meanwhile, in the state, when the light shielding rate D is equal to or more than 10%, the printer 100 does not transport toner. It is not preferable that a too small amount of toner stored in the developing chamber 546 causes low lubricity of the toner layer on the development roller 541, thereby causing high friction between the development roller 541 and the layer thickness regulating blade 544 and further causing a large load placed on the main motor 15.

Further, the printer 100 changes the threshold T during a specific period of time (hereinafter referred to as a "change period of time") for which the counter value P is equal to or more than 80% of the life number PL and less than the life number PL. It is noted that, during the change period of time, the threshold T may need to be within a range from 10 to 80. Namely, the printer 100 may change the threshold T from 80 to 10 at one time at a particular point of time during the change period of time. Alternatively, the printer 100 may change the threshold T from 80 to 10 in stages at a plurality of times during the change period of time. In this case, the printer 100 may change the threshold T in stages such that the threshold T gradually becomes smaller.

Subsequently, a procedure of a toner amount adjusting process for implementing the aforementioned toner amount adjusting operation will be described with reference to a flowchart shown in FIG. 6. The toner amount adjusting process is performed by the CPU 31 in response to the printer 100 being powered on.

In the toner amount adjusting process, first, the CPU 31 performs a new-device detecting process (S101). This is because the developing device 54 may have been replaced with a new one while the printer 100 was being powered off. A procedure of the new-device detecting process will be described with reference to a flowchart shown in FIG. 7.

In the new-device detecting process, the CPU 31 controls the new-device detector 70 to perform an operation to detect whether the developing device 54 is new (S201). For instance, in the printer 100 having the new-device detector 70 including the toothless gear, the CPU 31 rotates the drive gear by the rotational driving force from the main motor 15 and receives a signal from the new-device detector 70. It is noted that the drive gear is provided to the main body of the printer 100 and configured to transmit the rotational driving force from the main motor 15 to the rotational shaft of the development roller 541.

Then, based on the received signal, the CPU 31 determines whether the developing device 54 is new (S202). When determining that the developing device 54 is new (S202: Yes), the CPU 31 sets the counter value P stored in the NVRAM 34 to an initial value (e.g., zero) (S203). Further, the CPU 31 sets the threshold T stored in the NVRAM 34 to 80 (S204).

Then, after S204, or when determining that the developing device 54 is not new (S202: No), the CPU 31 terminates the new-device detecting process, and returns to the toner amount adjusting process. When the developing device 54 is replaced with a new one, the CPU 31 is preferred to reset the counter value P and the threshold T to respective values suitable for the new developing device 54.

Referring back to FIG. 6, after the new-device detecting process (S101), the CPU 31 performs the toner amount calculation (S102). As described above, the CPU 31 receives an output signal from the toner sensor 60 while rotating the agitator 543, thereby calculating the light shielding rate D. It is noted that the CPU 31 may perform the new-device detecting process and the toner amount calculation in parallel.

Next, the CPU 30 determines whether a print job has been received (S105). When determining that a print job has not been received (S105: No), the CPU 31 determines whether there is a possibility that the developing device 54 has been replaced with a new one (S106). For instance, when a cover of a section for housing the developing device 54 has been opened and closed, there is a possibility that the developing device 54 has been replaced with a new one.

When determining that there is a possibility that the developing device 54 has been replaced with a new one (S106: Yes), the CPU 31 goes back to S101 to execute the new-device detecting process. Meanwhile, when determining that there is not a possibility that the developing device 54 has been replaced with a new one (S106: No), the CPU 31 goes back to S105 and keeps waiting until the CPU 31 receives a print job.

When determining that a print job has been received (S105: Yes), the CPU 31 determines whether the light shielding rate D calculated in the latest toner amount calculation is less than the threshold T stored in the NVRAM 34 (S110). When determining that the light shielding rate D calculated in the latest toner amount calculation is not less than the threshold T stored in the NVRAM 34 (S110: No), the CPU 31 controls the image former 10 to perform printing of a single page (hereinafter, which may be referred to as "single-page printing") (S111). In the printing in execution, the printer 100 controls the developing device 54 to develop an electrostatic latent image carried on the photoconductive body 51 with toner stored in the developing chamber 546.

Meanwhile, when determining that the light shielding rate D calculated in the latest toner amount calculation is less than the threshold T stored in the NVRAM 34 (S110: Yes), the CPU 31 starts a toner supply operation (S112). Specifically, the CPU 31 controls the solenoid 17 such that the connection gear 16 comes into the connected state, and rotates the toner delivery pump 553 by the rotational driving force from the main motor 15. Thereby, toner is transported from the toner box 55 to the developing device 54.

Then, the CPU 31 controls the image former 10 to perform single-page printing while performing the toner supply operation (S113). After completion of the single-page printing, the CPU 31 stops the toner supply operation (S114). Specifically, the CPU 31 controls the solenoid 17 such that the connection gear 16 comes into the unconnected state, and stops the rotation of the toner delivery pump 553.

After S111 or S114, the CPU 31 updates the counter value P by adding, to the counter value P stored in the NVRAM 34, the number of rotations of the development roller 541 in the single-page printing (S117). Then, the CPU 31 performs a threshold setting process to update the threshold T stored in the NVRAM 34 (S118).

Subsequently, a procedure of the threshold setting process will be described with reference to a flowchart shown in FIG. 8. In the threshold setting process, first, the CPU 31 acquires the counter value P and the life number PL (S301). The counter value P is updated in the toner amount adjusting process and stored in the NVRAM 34. The life number PL is set depending on a type of the developing device 54 attached to the printer 100 and stored in the NVRAM 34. It is noted that, when the developing device 54 has a memory, the life number PL may be stored in the memory of the developing device 54.

Then, the CPU 31 sets the threshold T by comparison between the acquired counter value P and the life number PL. Specifically, first, the CPU 31 determines whether the counter value P is less than the life number PL multiplied by 0.8 (S303). When determining that the counter value P is less than the life number PL multiplied by 0.8 (S303: Yes), the CPU 31 sets the threshold T to 80 (S304).

Meanwhile, when determining that the counter value P is not less than the life number PL multiplied by 0.8 (S303: No), the CPU 31 determines whether the counter value P is less than the life number PL multiplied by 0.9 (S305). When determining that the counter value P is less than the life number PL multiplied by 0.9 (S305: Yes), the CPU 31 sets the threshold T to 50 (S306).

Meanwhile, when determining that the counter value P is not less than the life number PL multiplied by 0.9 (S305: No), the CPU 31 determines whether the counter value P is less than the life number PL multiplied by 0.95 (S307). When determining that the counter value P is less than the life number PL multiplied by 0.95 (S307: Yes), the CPU 31 sets the threshold T to 30 (S308).

Meanwhile, when determining that the counter value P is not less than the life number PL multiplied by 0.95 (S307: No), the CPU 31 determines whether the counter value P is less than the life number PL (S309). When determining that the counter value P is less than the life number PL (S309: Yes), the CPU 31 sets the threshold T to 20 (S310).

Meanwhile, when determining that the counter value P is not less than the life number PL (S309: No), the CPU 31 sets the threshold T to 10 (S311). Namely, as the counter number P increases, the CPU 31 makes the threshold T smaller in sequence from 80, in such a manner that the threshold T is 10 when the counter value P is equal to the life number PL.

It is noted that the counter value P not less than the life number PL (i.e., the counter value P equal to or more than the life number PL) denotes that the developing device 54 has reached an end of its service life. Hence, for instance, in S311, the printer 100 may control the operation panel 40 to display a message that the developing device 54 has reached the end of its service life, so as to prompt the users to replace the developing device 54 with a new one. Then, after execution of one of the steps S304, S306, S308, S310, and S311, the CPU 31 terminates the threshold setting process and returns to the toner amount adjusting process.

In the threshold setting process of the first illustrative embodiment, as shown in FIG. 9, the CPU 31 determines one of the five setting values for the threshold T such that the threshold T becomes smaller as the counter value P increases. Thereby, for instance, the amount of toner stored in the developing chamber 546 may vary as shown in FIG. 10. FIG. 10 exemplifies a variation of the light shielding rate D in the printer 100 that uses the threshold T shown in FIG. 9. The light shielding rate D, which corresponds to the amount of toner stored in the developing chamber 546, decreases through printing operations, whereas the light shielding rate D increases in response to toner being supplied with the threshold T as a maximum allowable value of the amount of toner stored in the developing chamber 546. Since the threshold T is made smaller in sequence, the amount of toner stored in the developing chamber 546 decreases gradually as a whole.

Referring back to FIG. 6, after the threshold setting process in S118, the CPU 31 performs the toner amount calculation (S120). Further, the CPU 31 determines whether the received print job has been completed (S121). When determining that the received print job has not been completed (S121: No), the CPU 31 goes back to S110 and controls the image former 10 to perform further single-page printing. At this time, when the light shielding rate D calculated in S120 is less than the threshold set in S118, the CPU 31 performs a toner supply operation in parallel with the single-page printing.

When determining that the received print job has been completed (S121: Yes), the CPU 31 goes back to S105 and keeps waiting until the CPU 31 receives a print job or determines that there is a possibility that the developing device 54 has been replaced with a new one.

As described above, in the first illustrative embodiment, when the developing device 54 has a sufficient remaining life, the printer 100 sets the threshold T to a large value and performs printing in a state where there is a sufficient amount of toner stored in the developing chamber 546. Thereby, it is possible to prevent deterioration of image quality caused by shortage of toner in the developing chamber 546. Meanwhile, when the developing device 54 reaches the end of its service life, the printer 100 sets the threshold T to a small value and performs printing in a state where there is a small amount of toner stored in the developing chamber 546. Thereby, when the developing device 54, which has reached the end of its service life, is replaced with a new one, it is possible to reduce an amount of toner remaining, without being used for development, in the developing chamber 546 of the old developing device 54. Namely, it is highly likely that the printer 100 of the first illustrative embodiment makes it possible to reduce an amount of toner to be disposed of along with the exhausted developing device 54.

Second Illustrative Embodiment

Subsequently, a second illustrative embodiment according to aspects of the present disclosure will be described. A printer 100 of the second illustrative embodiment has substantially the same configuration as exemplified in the aforementioned first illustrative embodiment. Nonetheless, the printer 100 of the second illustrative embodiment is configured to supply toner at timing different from the toner supply timing exemplified in the first illustrative embodiment. The second illustrative embodiment is different from the first illustrative embodiment in only a part of the toner amount adjusting process. In the second illustrative embodiment, substantially the same elements and processes as exemplified in the first illustrative embodiment will be provided with the same reference characters, and detailed explanations thereof may be omitted.

In the same manner as the aforementioned illustrative embodiment, the printer 100 of the second illustrative embodiment sets the threshold T based on the counter value P, and supplies toner when the light shielding rate D is less than the threshold T. In this respect, however, the second illustrative embodiment is different from the first illustrative embodiment in that the printer 100 does not supply toner during execution of printing but supplementarily supplies toner as needed after completion of single-page printing.

A procedure of the toner amount adjusting process in the second illustrative embodiment will be described with reference to a flowchart shown in FIG. 11. In the second illustrative embodiment as well, the CPU 31 performs the toner amount adjusting process in response to the printer 100 being powered on.

In the toner amount adjusting process of the second illustrative embodiment, first, the CPU 31 performs the new-device detecting process (S101). Then, the CPU 31 calculates the amount of toner stored in the developing chamber 546 (S102). Afterward, the CPU 31 keeps waiting until the CPU 31 determines that a print job has been received (S105: Yes) or determines that there is a possibility that the developing device 54 has been replaced with a new one (S106: Yes).

When determining that a print job has been received (S105: Yes), the CPU 31 performs single-page printing (S111). Further, the CPU 31 updates the counter value P (S117). Then, the CPU 31 performs the threshold setting process (S118). Afterward, the CPU 31 performs the toner amount calculation, thereby calculating the light shielding rate D (S120).

Then, the CPU 31 determines whether the light shielding rate D is less than the threshold T (S401). When determining that the light shielding rate D is less than the threshold T (S401: Yes), the CPU 31 performs the toner supply operation (S402). Namely, at this time, when the toner supply operation has not been started, the CPU 31 starts the toner supply operation. Meanwhile, when the toner supply operation has been started, the CPU 31 continues to perform the toner supply operation. Thereafter, the CPU 31 goes back to S120 and again performs the toner amount calculation. It is noted that the CPU 31 may perform the toner amount calculation in parallel with the toner supply operation.

When determining that the light shielding rate D is not less than the threshold T (S401: No), the CPU 31 stops the toner supply operation (S403). Namely, at this time, when the toner supply operation has been started, the CPU 31 stops the toner supply operation. Meanwhile, when the toner supply operation has not been started, the CPU 31 goes to a next step without starting the toner supply operation. Then, the CPU 31 determines whether the received job has been completed (S121).

As described above, in the same manner as the aforementioned first illustrative embodiment, it is highly likely that the printer 100 of the second illustrative embodiment also makes it possible to reduce an amount of toner to be disposed of along with the exhausted developing device 54. Further, in the second illustrative embodiment, since toner is supplementarily supplied as needed before single-page printing is started, it is highly likely that toner is sufficiently stored in the developing chamber 546 when the printer 100 starts single-page printing. Further, since the printer 100 repeatedly makes a comparison of the amount of toner stored in the developing chamber 546 with the threshold T while performing a toner supply operation, the printer 100 of the second illustrative embodiment is highly likely to make it possible to supply toner exactly until the amount of toner stored in the developing chamber 546 becomes an intended value corresponding to the threshold T. On the other hand, in the aforementioned first illustrative embodiment, the printer 100 concurrently performs single-page printing and a toner supply operation. Therefore, before starting the single-page printing, the printer 100 does not need to wait until a toner supply operation is completed. Consequently, the printer 100 of the first illustrative embodiment is highly likely to make it possible to shorten a period of time for executing a print job.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of its versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

Modifications

In the aforementioned first and second illustrative embodiments, in the threshold setting process, the printer 100 sequentially changes the threshold T in a plurality of stages. In this respect, the printer 100 may set the threshold T in at least two stages. Namely, in the threshold setting process, the printer 100 may set, as the threshold T, one of two different predetermined thresholds. Specifically, as shown in FIG. 12, the printer 100 may set a comparison value PA for the counter value P to satisfy a relationship of "PL×0.8≤PA<PL." In this case, the printer 100 may set the threshold T to 80 (i.e., T=80) when P<PA, and may set the threshold T to 10 (i.e., T=10) when P≥PA. Thus, this modification also provides an effect to reduce an amount of toner to be disposed of along with the exhausted developing device 54.

However, for instance, as indicated by a dashed line Q1 in FIG. 12, when the comparison value PA is set close to "PL×0.8," after setting the threshold T to 10 (i.e., T=10) in response to the counter value P reaching the comparison value PA, the printer 100 prints a large number of sheets until the end of the service life of the developing device 54. Hence, when the printer 100 repeatedly performs a printing operation with a density much higher than a standard density after the counter value P reaches the comparison value PA, it is likely that the printer 100 frequently perform a toner supply operation, and thus, it might cause a longer waiting time before printing.

Further, for instance, as indicated by a dashed line Q2 in FIG. 12, when the comparison value PA is set close to the life number PL, after setting the threshold T to 10 (i.e., T=10) in response to the counter value P reaching the comparison value PA, the printer 100 prints a small number of sheets until the end of the service life of the developing device 54. Hence, when the printer 100 performs printing with a density much lower than the standard density after the counter value P reaches the comparison value PA, it is likely that the developing device 54 reaches the end of its service life with a large amount of toner remaining in the developing chamber 546.

In the aforementioned first and second illustrative embodiments, in the threshold setting process, the printer 100 has a plurality of different setting values for the threshold T depending on the counter value P varying between the life number PL×0.8 and the life number PL. Therefore, according to the first and second illustrative embodiments, it is possible to concurrently satisfy two requirements, i.e., allowing the users to make comfortable use of the printer 100, and reducing the amount of toner remaining in the developing chamber 546 at the time of replacement of the developing device 54.

It is noted that aspects of the present disclosure may be applied to other apparatuses (e.g., a multifunction peripheral, a copy machine, and a facsimile machine) having a function of electrophotographic image formation, as well as a printer. Further, aspects of the present disclosure may be applied to color printing as well as monochrome printing.

Further, the counter value P, the light shielding rate D, and the threshold T may not necessarily be limited to the numerical values exemplified in the aforementioned first and second illustrative embodiments.

Further, the counter value P, for estimating a remaining period of time before the end of the service life of the developing device 54, is not limited to the accumulated number of rotations of the development roller 541. For instance, the counter value P may be an accumulated rotational angle of the development roller 541, or may be a value counted up each time the development roller 541 makes a predetermined number of rotations. Further, a remaining life of the developing device 54 may be estimated by counting down a specific counter value.

Further, in the aforementioned first and second illustrative embodiments, the amount of toner remaining in the developing chamber 546 is estimated based on the light shielding rate D. Nonetheless, for instance, a particular value corresponding to the amount of toner remaining in the developing chamber 546 may be calculated based on a rate of the third time period t3 of the light transmissive state to the first time period t1 required for a single rotation of the agitator 546.

Further, in the aforementioned first and second illustrative embodiments, when the developing device 54 reaches the end of its service life, the printer 100 displays on the operation panel 40 the message that prompts the users to replace the developing device 54. Nonetheless, the printer 100 may be configured to, when the developing device 54 reaches the end of its service life, not perform printing until the developing device 54 is replaced with a new one. Thus, by forbidding use of the exhausted developing device 54, it is possible to prevent printing of a deteriorated-quality image.

Further, in the aforementioned first illustrative embodiment, when starting a toner supply operation, the printer 100 continues to perform the toner supply operation during execution of single-page printing. Nonetheless, the printer 100 may perform toner amount calculation in parallel with single-page printing, and may stop the toner supply operation in response to the light shielding rate D reaching the threshold T.

Further, the processes exemplified in the aforementioned illustrative embodiments may be implemented by a single CPU, a plurality of CPUs, one or more hardware elements such as ASICs, or a combination including at least two of those elements. Further, the processes exemplified in the aforementioned illustrative embodiments may be implemented according to aspects of the present disclosure such as a method and a computer-readable medium storing computer-readable instructions for executing the processes.

Associations between elements exemplified in the aforementioned illustrative embodiments and elements according to aspects of the present disclosure will be exemplified below. The printer 100 may be an example of an "image forming apparatus" according to aspects of the present disclosure. The photoconductive body 51 may be an example of an "image carrying body" according to aspects of the present disclosure. The developing device 54 may be an example of a "developing device" according to aspects of the present disclosure. The development roller 541 may be an example of a "development roller" according to aspects of the present disclosure. The developing chamber 543 may be an example of a "developing chamber" according to aspects of the present disclosure. The toner box 55 may be an example of a "developer box" according to aspects of the present disclosure. The toner container 551 may be an example of a "developer container" according to aspects of the present disclosure. The toner delivery pump 553 may be an example of a "transporter" according to aspects of the present disclosure. The toner sensor 60 may be an example of a "developer sensor" according to aspects of the present disclosure. The NVRAM 34 may be an example of a "storage" according to aspects of the present disclosure. The counter value P may be an example of a "counter value" according to aspects of the present disclosure. The controller 30 may be an example of a "controller" according to aspects of the present disclosure. The CPU 31 and the ROM 32 storing the programs 32A may be included in the "controller" according to aspects of the present disclosure. The step S111 may be an example of a "developing process" according to aspects of the present disclosure. Further, the step S113 may be an example of a "developing process" according to aspects of the present disclosure. The step S117 may be an example of a "counting process" according to aspects of the present disclosure. The step S102 may be an example of a "developer remaining amount calculating process" according to aspects of the present disclosure. The light shielding rate D may correspond to a "remaining amount of developer in the developing chamber" according to aspects of the present disclosure. The step S118 may be an example of a "threshold setting process" according to aspects of the present disclosure. The threshold T may correspond to a "remaining amount threshold" according to aspects of the present disclosure. The step S112 may be an example of a "developer supply process" according to aspects of the present disclosure.

What is claimed is:

1. An image forming apparatus comprising:

an image carrying body configured to carry an electrostatic latent image thereon;

a developing device comprising:

a development roller configured to carry developer thereon; and a developing chamber configured to store developer therein;

a developer box comprising:

a developer container configured to store developer therein; and a transporter configured to transport the developer stored in the developer container to the developing chamber of the developing device;

a developer sensor configured to output a signal varying depending on an amount of the developer stored in the developing chamber;

a storage configured to store a counter value; and a controller configured to perform:

a developing process to control the developing device to supply the developer stored in the developing chamber to the electrostatic latent image carried on the image carrying body, thereby developing the electrostatic latent image;

a counting process to, each time the development roller rotates by a particular rotational amount, increment the counter value stored in the storage;

a developer remaining amount calculating process to calculate a remaining amount of developer in the developing chamber, based on the signal received from the developer sensor;

a threshold setting process comprising:

when the counter value is less than a first value, setting a remaining amount threshold to a first threshold; and when the counter value is equal to or more than a second value, setting the remaining amount threshold to a second threshold, the second value being equal to or more than the first value, the second threshold being less than the first threshold; and a developer supply process to, when the calculated remaining amount is less than the set remaining amount threshold, control the transporter to transport the developer stored in the developer container to the developing chamber.

2. The image forming apparatus according to claim 1, wherein the threshold setting process further comprises:

when the counter value is equal to or more than the first value and less than the second value, setting the remaining amount threshold to a third threshold, the third threshold being less than the first threshold and more than the second threshold.

3. The image forming apparatus according to claim 1, further comprising a new-device detector configured to output a signal varying depending on whether the developing device is new, wherein the controller is further configured to, in response to receiving, from the new-device detector, a signal representing that the developing device is new, set the counter value to an initial value and set the remaining amount threshold to the first threshold.

4. The image forming apparatus according to claim 1, wherein the developer supply process comprises:

while performing the developing process, controlling the transporter to transport the developer stored in the developer container to the developing chamber.

5. The image forming apparatus according to claim 1, wherein the developer supply process comprises:

during a period of time for which the developing process is not performed, controlling the transporter to transport the developer stored in the developer container to the developing chamber, until the calculated remaining amount becomes equal to or more than the remaining amount threshold.

6. The image forming apparatus according to claim 1, wherein the first value and the second value are equal to a particular value.

7. The image forming apparatus according to claim 1, wherein the controller comprises:

a processor; and a memory storing processor-executable instructions configured to, when executed by the processor, cause the processor to perform:

the developing process;

the counting process;

the developer remaining amount calculating process;

the threshold setting process; and the developer supply process.

8. A method implementable on a processor coupled with an image forming apparatus, the image forming apparatus comprising:

an image carrying body configured to carry an electrostatic latent image thereon;

a developing device comprising:

a development roller configured to carry developer thereon; and a developing chamber configured to store developer therein;

a developer box comprising:

a developer container configured to store developer therein; and a transporter configured to transport the developer stored in the developer container to the developing chamber of the developing device;

a developer sensor configured to output a signal varying depending on an amount of the developer stored in the developing chamber; and a storage configured to store a counter value, the method comprising:

controlling the developing device to supply the developer stored in the developing chamber to the electrostatic latent image carried on the image carrying body, thereby developing the electrostatic latent image;

each time the development roller rotates by a particular rotational amount, incrementing the counter value stored in the storage;

calculating a remaining amount of developer in the developing chamber, based on the signal received from the developer sensor;

when the counter value is less than a first value, setting a remaining amount threshold to a first threshold, whereas, when the counter value is equal to or more than a second value, setting the remaining amount threshold to a second threshold, the second value being equal to or more than the first value, the second threshold being less than the first threshold; and when the calculated remaining amount is less than the set remaining amount threshold, controlling the transporter to transport the developer stored in the developer container to the developing chamber.

9. A non-transitory computer-readable medium storing computer-readable instructions that are executable by a processor coupled with an image forming apparatus, the image forming apparatus comprising:

an image carrying body configured to carry an electrostatic latent image thereon;

a developing device comprising:

a development roller configured to carry developer thereon; and a developing chamber configured to store developer therein;

a developer box comprising:

a developer container configured to store developer therein; and a transporter configured to transport the developer stored in the developer container to the developing chamber of the developing device;

a developer sensor configured to output a signal varying depending on an amount of the developer stored in the developing chamber; and a storage configured to store a counter value, the instructions being configured to, when executed by the processor, cause the processor to perform:

a developing process to control the developing device to supply the developer stored in the developing chamber to the electrostatic latent image carried on the image carrying body, thereby developing the electrostatic latent image;

a counting process to, each time the development roller rotates by a particular rotational amount, increment the counter value stored in the storage;

a developer remaining amount calculating process to calculate a remaining amount of developer in the developing chamber, based on the signal received from the developer sensor;

a threshold setting process comprising:

when the counter value is less than a first value, setting a remaining amount threshold to a first threshold; and when the counter value is equal to or more than a second value, setting the remaining amount threshold to a second threshold, the second value being equal to or more than the first value, the second threshold being less than the first threshold; and a developer supply process to, when the calculated remaining amount is less than the set remaining amount threshold, control the transporter to transport the developer stored in the developer container to the developing chamber.

10. The non-transitory computer-readable medium according to claim 9, wherein the threshold setting process further comprises:

when the counter value is equal to or more than the first value and less than the second value, setting the remaining amount threshold to a third threshold, the third threshold being less than the first threshold and more than the second threshold.

11. The non-transitory computer-readable medium according to claim 9, wherein the image forming apparatus further comprises a new-device detector configured to output a signal varying depending on whether the developing device is new, and wherein the instructions are further configured to, when executed by the processor, cause the processor to:

in response to receiving, from the new-device detector, a signal representing that the developing device is new, set the counter value to an initial value and set the remaining amount threshold to the first threshold.

12. The non-transitory computer-readable medium according to claim 9, wherein the developer supply process comprises:

while performing the developing process, controlling the transporter to transport the developer stored in the developer container to the developing chamber.

13. The non-transitory computer-readable medium according to claim 9, wherein the developer supply process comprises:

during a period of time for which the developing process is not performed, controlling the transporter to transport the developer stored in the developer container to the developing chamber, until the calculated remaining amount becomes equal to or more than the remaining amount threshold.

14. The non-transitory computer-readable medium according to claim 9, wherein the first value and the second value are equal to a particular value.

* * * * *